US007077060B2

(12) United States Patent
Eriksen

(10) Patent No.: US 7,077,060 B2
(45) Date of Patent: Jul. 18, 2006

(54) CONTAINER FOR COMPACTING PAPER WASTE

(75) Inventor: Bent Eriksen, Hørve (DK)

(73) Assignee: SHARK Solutions A/S, Svinninge (DK)

( * ) Notice: Subject to any disclaimer, the term of this patent is extended or adjusted under 35 U.S.C. 154(b) by 0 days.

(21) Appl. No.: 10/475,349

(22) PCT Filed: Apr. 19, 2002

(86) PCT No.: PCT/DK02/00255

§ 371 (c)(1),
(2), (4) Date: Dec. 2, 2003

(87) PCT Pub. No.: WO02/085610

PCT Pub. Date: Oct. 31, 2002

(65) Prior Publication Data

US 2004/0112229 A1 Jun. 17, 2004

(30) Foreign Application Priority Data

Apr. 19, 2001 (DK) ..... 2001 00624
Jul. 6, 2001 (DK) ..... 2001 01062

(51) Int. Cl.
*B30B 9/30* (2006.01)

(52) U.S. Cl. ..... 100/229 A; 100/214; 100/233; 414/525.51

(58) Field of Classification Search ..... 100/214, 100/215, 229 A, 233; 414/513, 525.5, 525.51, 414/525.52, 525.53, 525.54, 525.6
See application file for complete search history.

(56) References Cited

U.S. PATENT DOCUMENTS

| | | | | |
|---|---|---|---|---|
| 3,749,261 | A * | 7/1973 | Herpich et al. | 414/517 |
| 3,881,613 | A * | 5/1975 | Torimoto et al. | 414/525.51 |
| 4,103,608 | A | 8/1978 | Chenot | |
| 4,271,756 | A | 6/1981 | Bettencourt | |
| 4,786,228 | A | 11/1988 | Mazzocchia et al. | |
| 5,056,428 | A | 10/1991 | Allen | |
| 5,421,252 | A * | 6/1995 | Reichel | 100/193 |

FOREIGN PATENT DOCUMENTS

| | | |
|---|---|---|
| DE | 2408356 | 8/1975 |
| DE | 2516202 | 11/1976 |
| FI | 95751 | 12/1995 |
| FR | 2748998 | 11/1997 |
| GB | 1240584 | 7/1971 |
| GB | 2102728 | 2/1983 |

* cited by examiner

*Primary Examiner*—Derris H. Banks
*Assistant Examiner*—Jimmy T. Nguyen
(74) *Attorney, Agent, or Firm*—James Creighton Wray

(57) ABSTRACT

A compacting container compresses cellulose-containing waste, paper and cardboard. The container has a filling opening which can be closed by a door and pulling hydraulic cylinders. The door pivots about a horizontal axis at the bottom of the container. A compressor mounted at the filling end, extends across an interior of the container and is suspended by one side edge on a shaft traversing the container at a beam. The waste is filled into the door and its side edges. When the door is full the compressor is activated as respective cylinders pivot the transverse compressor down against the paper waste. Shovelling occurs into the container while the door is simultaneously drawn against the container open end. Waste is compressed into container the interior. A greater container volume is used, and the pressing force is further reduced for simple location of the pulling cylinders along the container sides.

11 Claims, 7 Drawing Sheets

CONTAINER FOR COMPACTING PAPER WASTE

This application claims the benefit of Danish Application No. PA 2001 00624 filed Apr. 19, 2001, Danish Application No. PA 2001 01062 filed Jul. 6, 2001, and PCT/DK02/00255 filed Apr. 19, 2002.

BACKGROUND OF THE INVENTION

The invention concerns a container for compacting paper waste. As paper waste is also regarded other pliable cellulose-containing waste like cardboard and laminates comprising a substantial constituent of this. The invention is also applicable with other sheet-formed and slightly elastic materials.

Such compacting containers for industrial application are prior art, e.g. from public recycling stations, where the waste may be dumped into an upwardly facing opening under which there is a hydraulic piston mechanism which is activated at suitable time intervals for compacting the waste delivered into the container. In these compacting containers, a driving mechanism, i.e. hydraulic cylinders and possible hydraulic pumps, are situated at one side of the opening while the compartment, in which the waste is compressed and stored, is arranged at the other side of the opening. Such devices are known, e.g. from DE 42 30 775 and 42 11 059. A substantial part of the container volume is constituted by the hydraulic compacting device. This is an unsuitable design as the dimensions of the containers are limited in order to be transported by lorry, and since the container volume therefore cannot be utilised for storing and transport.

DE-A1-24 19 352 describes a compacting container where a compacting device in the form of a door may press the waste into the container and mainly in the horizontal direction with hydraulic cylinders provided along the sides of container. The door is disposed at the filling end of the container and suspended pivotably about a horizontal axis at the lower edge of the container and is provided with upright sides at its lateral edges perpendicularly to the axis, as the door can pivot between an open filling position in which it is projecting out from the container and a closed position in contact with the container. The invention concerns such a compacting container.

Since the hydraulic cylinders are disposed at the sides of the container, the useful volume of the container is increased. The door with the upright sides functions as collecting container, and in the closed position of the door, this collecting container does not take up space because the upright sides are moved along the fixed sides of the container. In this construction, the paper waste is compressed only by the compacting of the door of the waste at the filling opening. Since the main part of the mixed paper waste acts resiliently when subjected to pressure, the waste will follow (expand) when the door is opened again for receiving a new portion of waste. Therefore, by this construction it will be limited how much waste may be compressed, and, compared with the above mentioned constructions which usually have a piston pressing the waste far into the container, not as much may be compacted.

SUMMARY OF THE INVENTION

The peculiar features of the invention are that the container, besides a compacting device in the form of a the door suspended pivotably about a horizontal axis at the lower edge of the container and provided with upright sides at its lateral edges perpendicularly to the axis which can press the waste into the container mainly in horizontal direction, is also including at least one further compressing means, which is preferably mounted at the filling end, where the said compression means consists of at least one pivotably suspended compression element, where the compression means extends across the interior of the container and is suspended at one side edge on a shaft disposed transversely in the container at a bean.

The paper waste, which often contains cardboard, is filled into the upwardly open hopper constituted by the door and the two sides disposed along respective lateral edges of the door as there is open passage to the inner of the container. When this "container" is sufficiently filled, a hydraulic control system for the hydraulic cylinders is activated, as respective cylinders pivot the transverse compression means down against the paper waste, whereby a shovelling is almost performed into the container while simultaneously the door is drawn in against the open end of the container, whereby the paper waste is compressed in the interior of the container.

As the container is filled, an elastic force from the compressed material trying to press the waste out through the opening again is created. In order to counteract this problem, there are e.g. known types of retainers along the side of the container. These will here catch the outermost, present edges of paper waste and hold it back. When the door is opened again, the retainer will thus counteract falling out of the paper waste and therefor maintain most of the paper waste inside the container. By renewed filling of paper waste by closing the door, the same process will be repeated. It appears that in this way, a far better utilisation of the container volume is achieved.

In a preferred embodiment, the transverse beam by which the pivotably suspended compression means is mounted, is provided with retainers along its underside, in the form of a pointed edge that extend downward and inward in the container, and where access to the interior of the container is only possible under the beam, as a plate is mounted between the beam and a ceiling of the container.

By the blocking plate and with the retainers disposed at the underside of the beam it is ensured that the compressed waste is effectively retained.

In a preferred embodiment, the pivoting compressing means has a plate shaped body part with uniform cross-section in its longitudinal direction, and which may be built up as a hollow construction of welded steel plates so that an even outer side is achieved, but other designs are of course possible, e.g. with external ribs.

The compacting container according to the invention may be with a container door, which along its inner side near the upper edge and in its width is provided with a curved scraper plate having a radius so that the extreme point of the compression means can follow the contour of the scraper plate in the partly closed state of the door. This scraper plate interacts with the compression means whereby improved compacting of the waste is achieved.

In order to increase compression, the door may, be provided with at least one compacting means in the form of a plate-shaped projection extending towards the inner of the container. Thereby, the waste is pressed a short distance past the retainers along the container sides which thereby may better catch the waste when it tries to expand opposite the pressing direction. The compacting means on the door may be fastened rigidly at the upper edge of the door or other places at the inner side of the door, but may also comprise a compacting means consisting of at least one flap extending across most of the width of the door and suspended pivotably about a horizontal axis on the door and controlled in such a way in relation to the door so that it is largely directed in parallel with the pressing direction during the pivoting movement of the door. This pivotable flap may advantageously be disposed close to the central part of the door. The parallel guiding of the flap ensures that the compacting function of the flap always occurs in the optimal pressing direction.

The flap may be designed in a slightly tapering way whereby the waste at the middle of the door is pressed more into the inner of the container than the waste at the sides of the container due to the greater dimension of the flap at the centre. In this way, the waste is deformed and compressed as in a curve away from the door, while the edges of the paper and cardboard waste are retained by the retainers at the sides of the container.

A simple embodiment of the parallel guide of the pivotable flap may consist of a parallel member guide by means of rods connecting the rod with a fixed point on the container outside the door via a pivoting joint.

The compacting container according to the invention may furthermore be made with other retainers provided at the upper side of the container. They may consist of several pivotable fingers distributed over the width of the container and suspended by hinges and limited by stops so that the fingers may freely pivot between a position pointing along the upper side of the container and mainly in the direction of pressing, and a position transversely of the pressing direction. Hereby, in a completely filled container, is achieved additional security against paper waste being pressed out between the upper edge of the container and the upper edge of the door, as it is not, like the three other side edges along its filling opening, provided with a kind of sides or other limitation. Thus it is avoided that the paper waste does not protrude and gets caught between the upper edge of the door and the upper edge of the container along the filling opening.

In connection with the compacting container to be loaded onto a lorry provided with a container lift, i.e. with a hook which can engage a strap at one end of the container, it is preferred that the door is provided with pins at opposite lateral edges and spaced apart from its axis of pivot, the pins being capable of engaging complementing locks provided on the fixed sides of the container in the closed position of the door. The strap may thus be provided on the door, and when the pins are locked into the locks on the container, the pulling force from the lorry hook may be transmitted via the pins to the container.

A compacting container with compression means according to the invention is provided with a peculiar hydraulic control circuit for use in actuation of hydraulic cylinders driving compression means.

BRIEF DESCRIPTION OF THE DRAWINGS

Preferred embodiments of the invention are described below with reference to the drawing, in which.

DETAILED DESCRIPTION OF THE PREFERRED EMBODIMENTS

Figure 1:
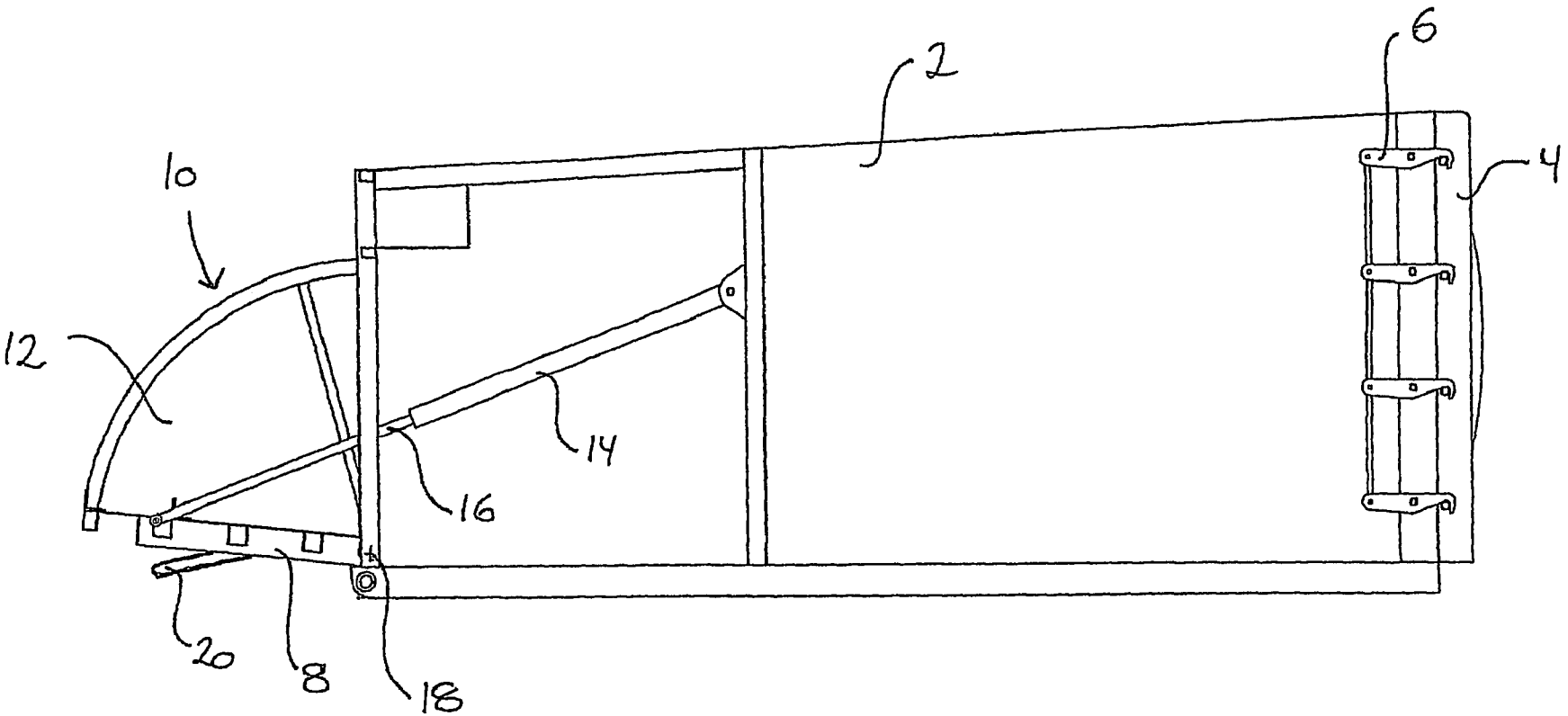
FIG. 1 shows an embodiment of the compacting container according to the invention, as seen from the side.

The compacting container according to the invention may be designed as shown on FIG. 1, where the container itself (intended for collecting paper waste) is designated 1 and an discharge door at the rear end of the container 2 is designated 4. A locking mechanism 6 holds the discharge door 4 in its closed position. As shown, the container 2 may be made with a slightly increasing cross-section towards the door 4 for facilitating unloading but it is also possible to make it with top side and bottom in parallel.

At its other end, the container is provided with a filling opening situated perpendicularly to the paper plane. Paper waste, including cardboard and laminates thereof, may be filled into a collecting compartment designated 10. The compartment 10 is formed by a door 8 covering the whole filling opening and upright sides 12 disposed at the lateral edges of the door 8. When the door 8 is closed by means of hydraulic cylinders 14, one at each side of the container 1, the upright sides 12 are displaced into the container 2.

The hydraulic cylinder 14 is exposed on FIG. 1 as there is normally a plate covering the cylinder 14 towards the surroundings in order to avoid damage and other hindrances to the cylinder movement during extension and retraction of its piston rod 16.

The door 8 is thus closed by retracting the piston rod 16 in the cylinder 14 as the door 8 pivots about an axis 18 which is disposed at the filling opening at the bottom of the container.

Figure 2:
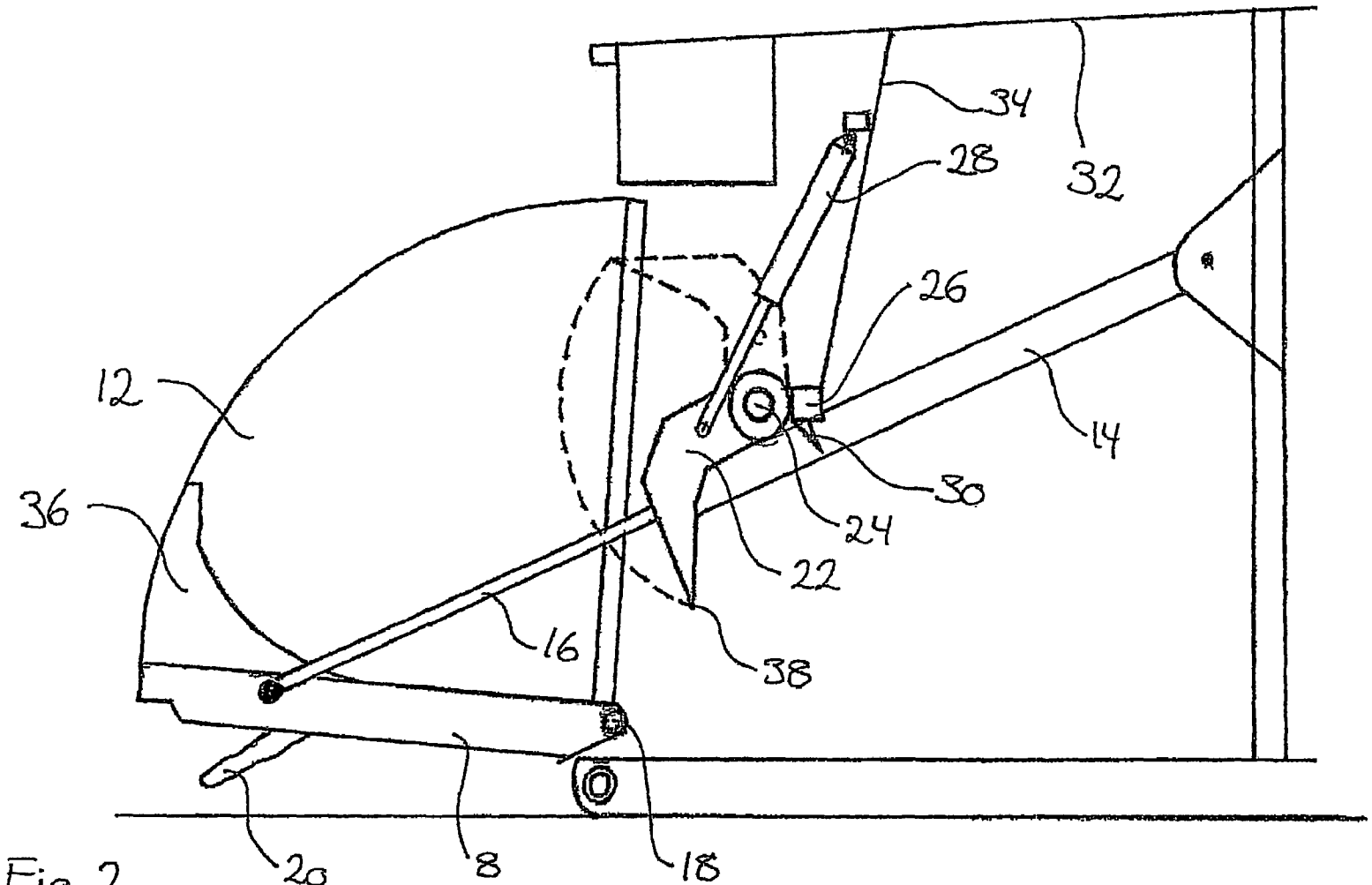
FIG. 2 shows in a schematic way the compacting arrangement with the door in open condition, as seen from the side.
Figure 3:
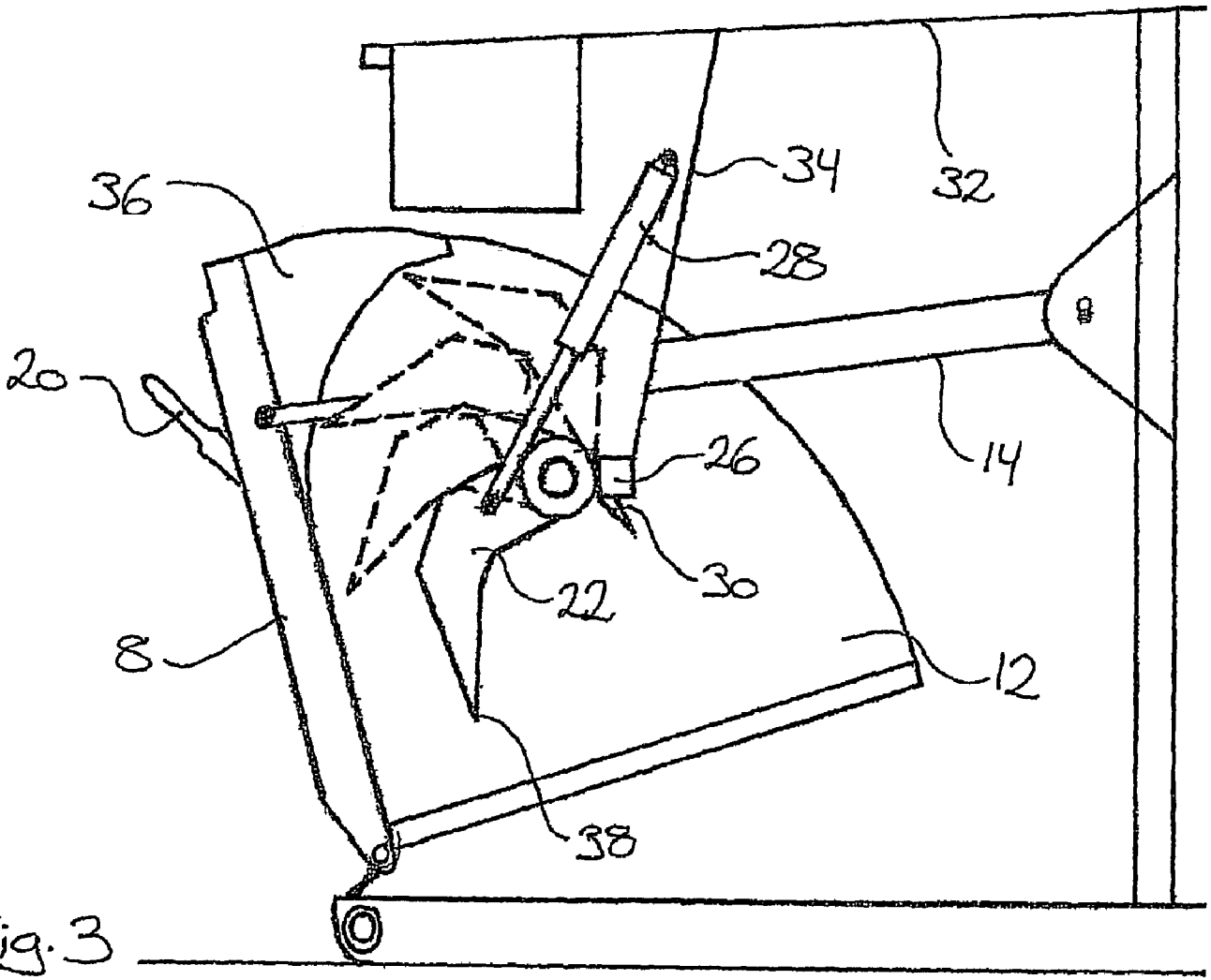
FIG. 3 shows the door as in FIG. 2, but in partially closed condition.
Figure 4:
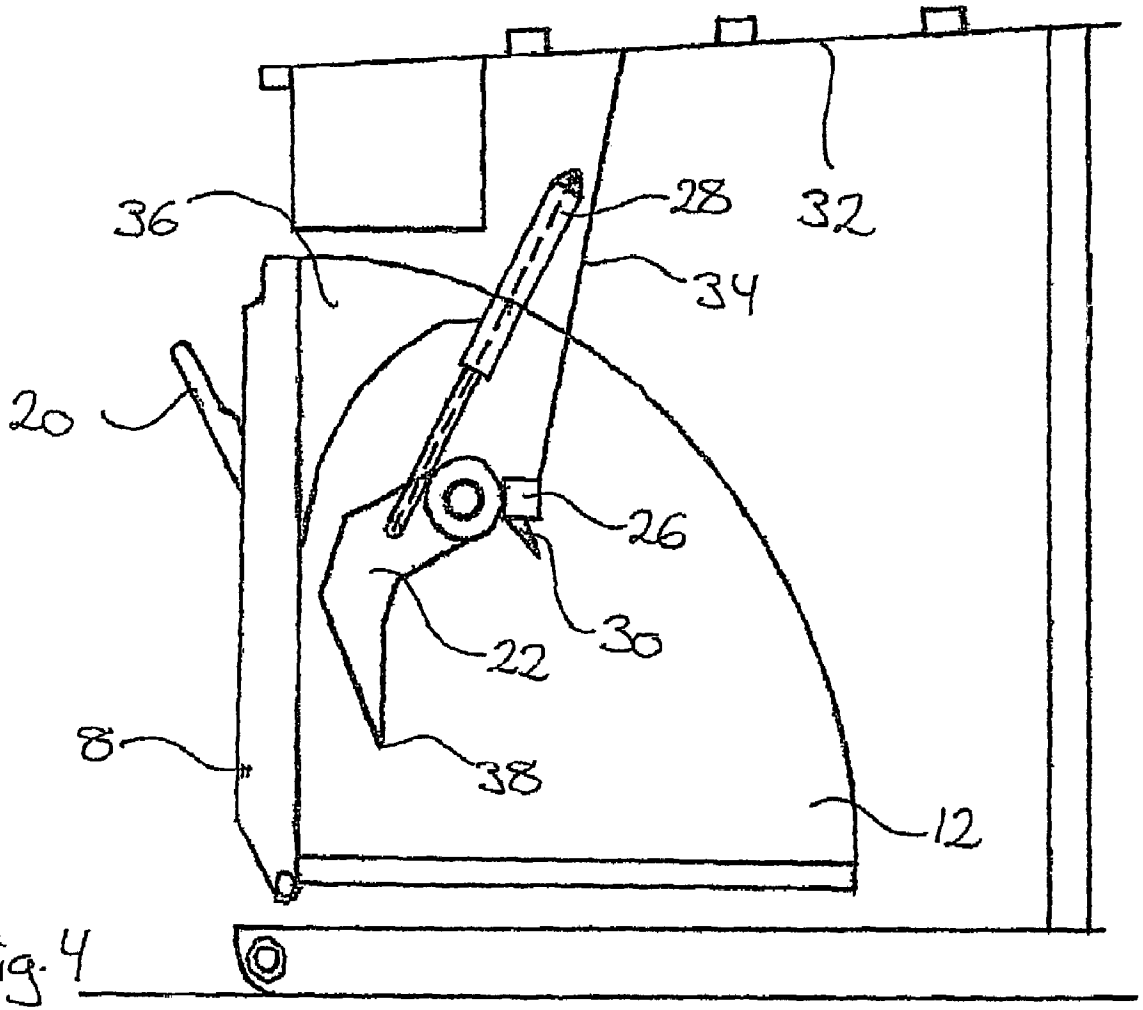
FIG. 4 shows the same as FIG. 2, but with the door in completely closed condition, FIG. 5 an embodiment of a compression means.

On FIGS. 2, 3 and 4 are seen three different situations during closing of the door 8. It is noted that the closing movement, which also causes compression of the paper waste, is performed by pulling action in the piston rods 16, as the smaller piston area in the cylinders 14 may be sufficient to use due to the advantageous embodiment of the compacting container according to the invention. It is also to be noted that in other embodiments not shown here, it is possible to use the extension movement of the cylinders and thereby the larger pressure area in the cylinders 14 in order to achieve a greater force. However, this is to be avoided since it will either imply a less suitable disposition of the cylinders or the use of a complicating articulated joint between cylinder 14 and door 8.

The container 2 is of the type which may be lifted up upon the platform of a lorry by means of a containerlift with a hook, and for engaging the hook there is a strap 20 on the outer side of the door 8. In order to transmit the pulling force from the door to the container when loading the container, there are pins at both sides of the upper edge of the door and which may engage a locking device provided at the upper side of the container. It is to be noted that this locking device is hidden between two plates along the sides of the container in an interspace which may also accommodate the upright sides 12 during the closing movement.

A preferred embodiment of compression means is shown on FIGS. 2–4. Inside the container 2 and near the door 8 there is a shovel-shaped, pivotable compression means 22 which extend transversely of the interior of the container with uniform cross-section. The means 22 is suspended at one side edge thereof on a transversely disposed shaft 24 by a beam 26 and may be moved with hydraulic cylinders 28 between an upper start position and a lower final position, corresponding to the dotted and the continuous contour, respectively, on FIG. 2. The cylinders are suspended at each their side of the container 2. The means 22 is here built up as a hollow construction of welded steel plates so that an even outer side is achieved, but other designs are of course possible, e.g. with external ribs.

Along its underside, the beam 26 is provided with a retainer 30 in the shape of a pointed edge extending downwards and inwards in the container 2. Between the beam 26 and the ceiling 32 in the container, there is mounted a plate 34 so that access to the interior of the container only exists under the beam 26.

Along its inner side near the upper edge, the door 8 is provided over its width with a curved scraping plate 36 having a radius so that the extreme point 38 of the means 22 can follow the contour of the plate in the partly closed condition as shown on FIG. 3.

When filling the container 2, the door 8 is completely open as on FIG. 2, as the means 22 can be activated for single movements for removing material from the space 10 between the door 8 and sides 12. When the door 8 then performs a partial compression as shown on FIG. 3, the scraping plate 36 ensures that no waste remains in the top near the remaining slot between door 8 and the upper edge of the container when the means 22 is activated and performs compression movements. During these compression movements, the retainer 30 is counteracting that waste is pressed back against the door 8 due to the elasticity of the waste. Furthermore, the plate 34 prevents that waste is carried over the beam 26 and in on the back side of the means 22 due to the elasticity. When the door 8 then is to close completely and to perform final compression, the means 22 is put in its lower position as shown on FIG. 4.

Figure 5:
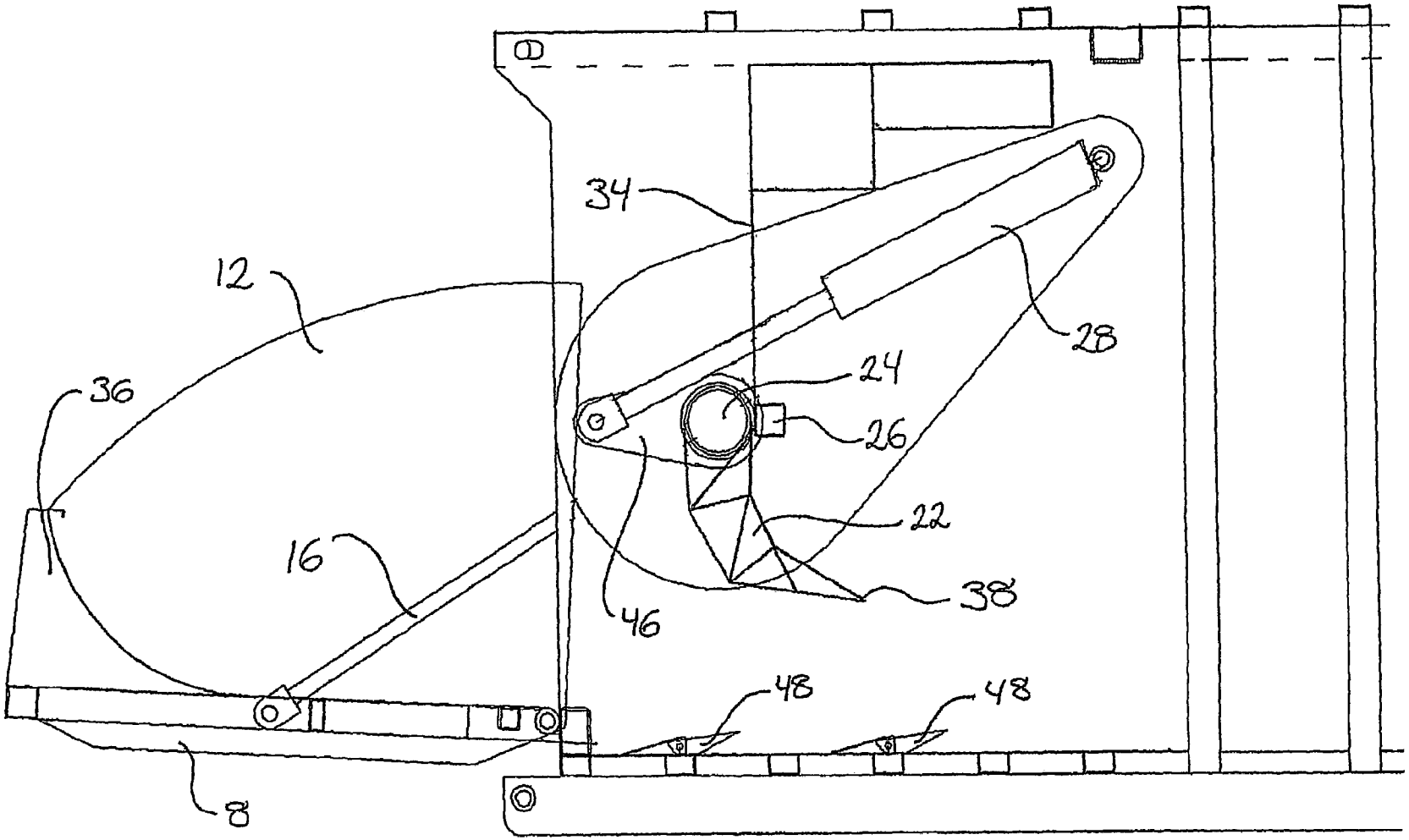

On FIG. 5 is shown a preferred embodiment of a compacting container 2 according to the invention, where the compression means 22 is connected to the hydraulic cylinder 28 via a firm connecting arm 46. In this way, increased mobility of the compression means 22 is achieved, as rotation of at least 180' is now allowed. This increased movement thus implies that with the same compression means 22 there may be performed an increased compacting of the waste. Furthermore, as seen on FIG. 5 retainers 48 are placed at the bottom of the container 2. These retainers 48 are directed towards the inner of the container and possibly interact with other retainers 30 shown on FIGS. 1–4 and as discussed elsewhere in the text.

Activation of the cylinders 28 may occur manually or depending on a hydraulic control system. Furthermore, the compression means 22 and the retainer 30 may be combined with other retainer devices as described above.

Figure 6:
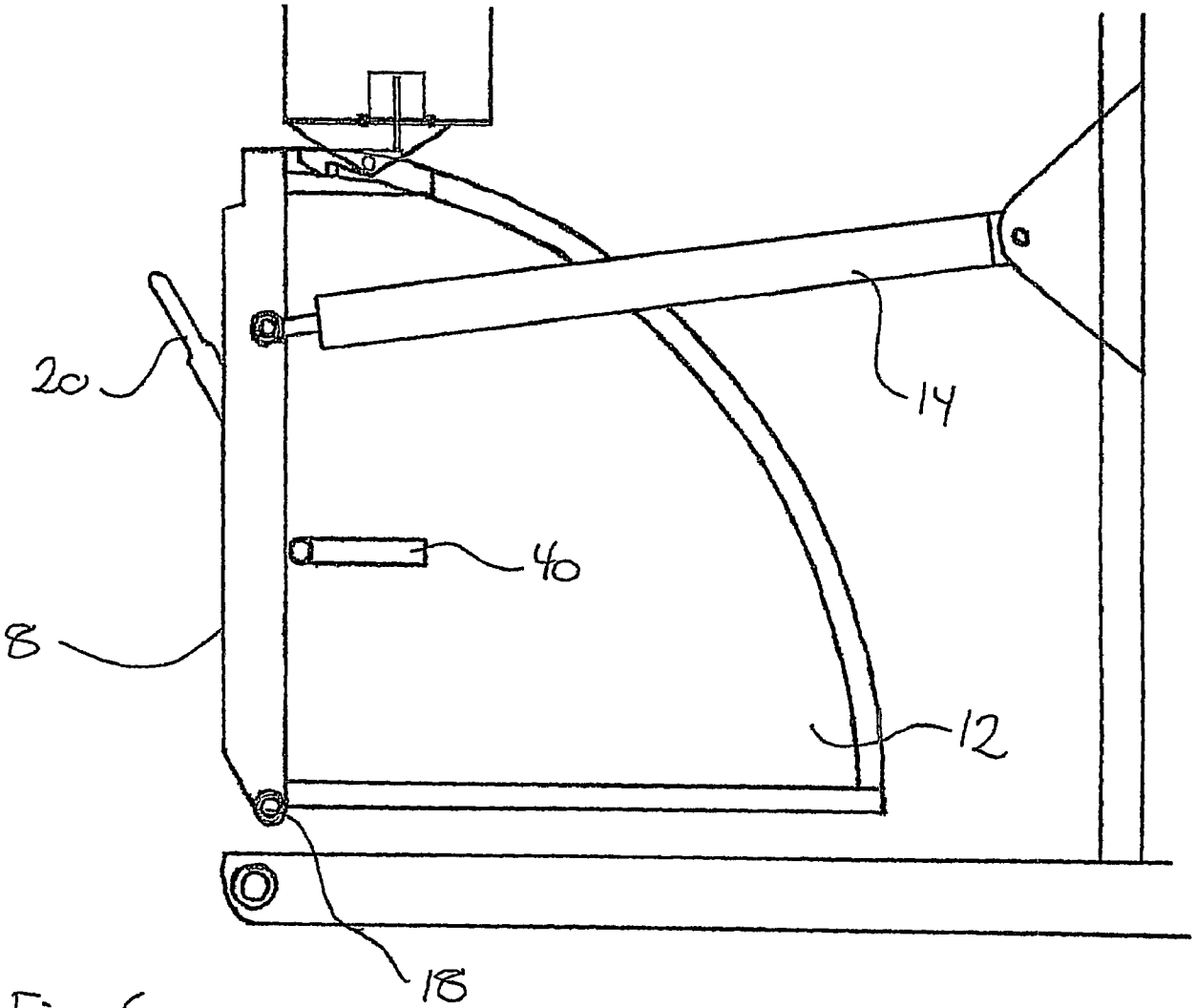
FIG. 6 shows the door with compression means in completely closed condition.
Figure 7:
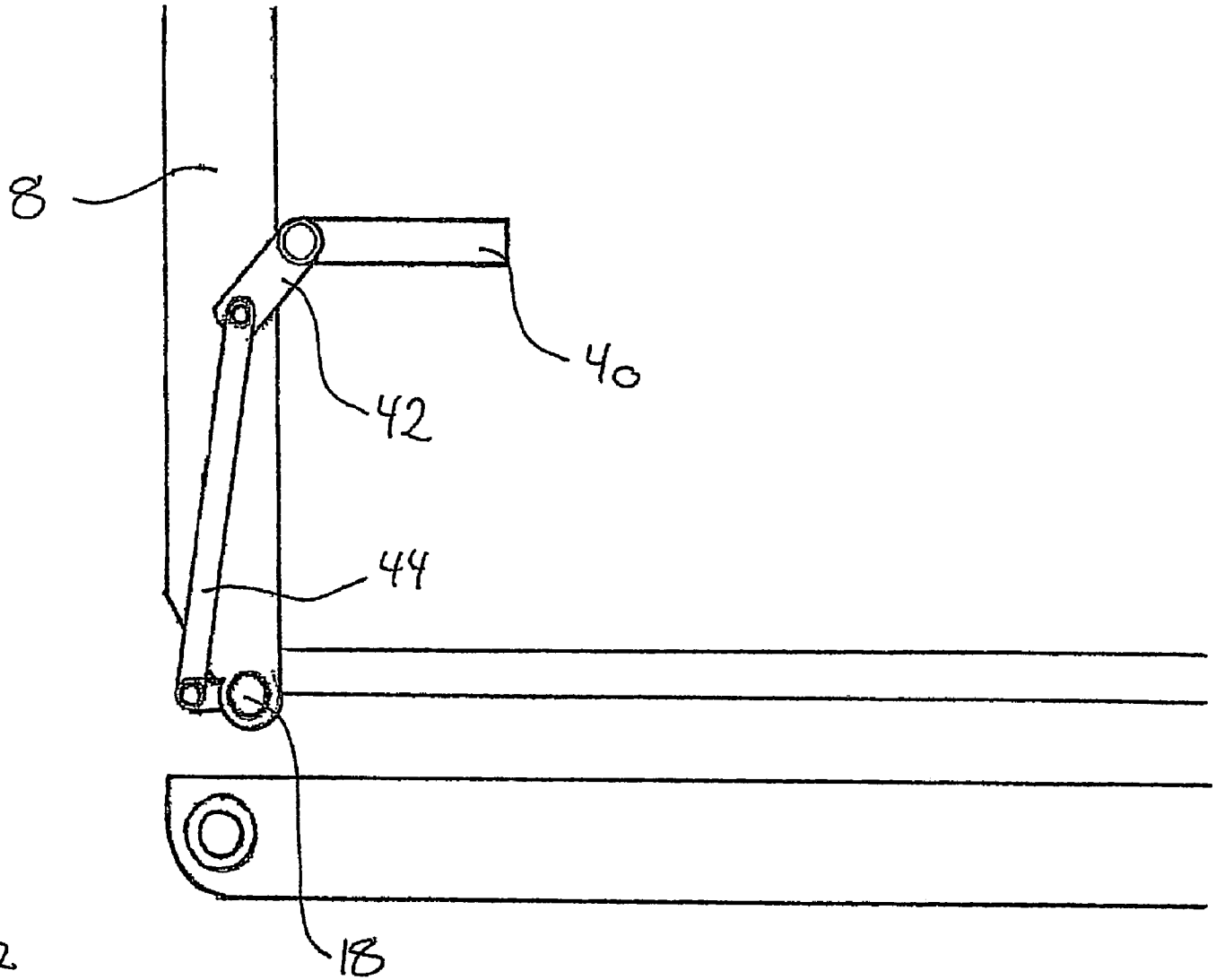
FIG. 7 shows a partial vertical section through the door with a parallel member guide for a pivotable flap.

In order to increase compression of the paper waste, the door 8 may, as shown on FIGS. 6 and 7, be provided with a compacting means consisting of a pivoting flap 40 which is pivotably connected to the door 8 and kept in position approximately in parallel with the container bottom by means of a parallel member arrangement consisting of rods 42 and 44, see FIG. 7. The pressing direction of the flap is thus always largely parallel with the ideal pressing direction for the paper waste.

The compacting means 40 interacts with retainers of different kind, which are disposed at the inner sides of the container. These retainers may extend in vertical direction at both sides along vertical inner sides of the container. It is preferred to dispose the retainers close to the filling opening and thereby to the compression means 22 and 40 to ensure that the paper waste does not flow out when the door 8 is opened.

The hydraulic cylinders 14, and thereby the closing and opening function of the pressing container, may of course be controlled in a commonly known way by means of a valve block which is operated manually. Such a function may of course be supplemented by safety measures with regard to the function and requirements of the authorities, and these safety measures will not be described in detail as they are within the options of the skilled in the art.

The invention claimed is:

1. Compacting apparatus comprising a container for compacting paper waste, a compacting device communicating with the container for pressing the waste into the container, hydraulic cylinders provided along sides of the container, a door coupled to the container and coupled to the compacting device, the door being suspended pivotably about a horizontal axis at a lower edge of a filling end of the container for pivoting between an open filling position when the door pivots out from the container and a closed position when the door pivots in to contact the container, the door comprising upright sides at lateral edges extending perpendicular to the axis, a beam in the container and a shaft disposed transversely in the container proximal the beam, at least one compression device mounted at the filling end, the compression device comprising at least one pivotably suspended compression element, the compression device having a curved shovel shape and extending across an interior of the container, and a side edge of the compression device being coupled to the shaft for pivotably suspending the compression device on the shaft.

2. The apparatus of claim 1, wherein the beam comprises a retainer along an underside of the beam, the retainer extending downward and inward in the container.

3. The apparatus of claim 2, wherein the retainer comprises a pointed edge.

4. The apparatus of claim 2, further comprising a plate mounted between the beam and a ceiling of the container for limiting access to interiors of the container through the underside of the beam.

5. The apparatus of claim 1, wherein the compression device comprises a plate shaped body.

6. The apparatus of claim 3, wherein the door further comprises a curved scraper plate extending along an inner side near an upper edge and along a width of the door, the curved scraper plate having a radius for accommodating the edge of the compression device along a contour of the scraper plate when the door is in a partially closed state.

7. The apparatus of claim 1, wherein the compacting device comprises at least one compacting element extending into the container.

8. The apparatus of claim 7, wherein the compacting element is a plate-shaped projection.

9. The apparatus of claim 8, wherein the compacting element further comprises at least one flap extending across the door.

10. The apparatus of claim 9, wherein the compacting element is pivotably suspended about a horizontal axis on the door thereby having a controlled movement in relation to the door such that the compacting element is largely parallel to a pressing direction during a pivoting movement of the door.

11. The apparatus of claim 10, further comprising a parallel member guide for controlling parallel movement of the flap.

* * * * *